US005115894A

United States Patent [19]

Kuo

[11] Patent Number: 5,115,894

[45] Date of Patent: May 26, 1992

[54] STRUCTURE OF A HANDLE WITH FASTENING FUNCTION

[75] Inventor: Long-Far Kuo, Taipei, Taiwan

[73] Assignee: Ping Ho Liao, Taipei, Taiwan

[21] Appl. No.: 726,566

[22] Filed: Jul. 8, 1991

[30] Foreign Application Priority Data

Jun. 22, 1991 [TW] Taiwan ..... 80207515

[51] Int. Cl.[5] ..... B65D 25/28

[52] U.S. Cl. ..... 190/117; 190/118; 220/94 R

[58] Field of Search ..... 190/39, 117, 118; 220/94 R; 16/110.5

[56] References Cited

U.S. PATENT DOCUMENTS 1,533,149 4/1925 Tueckmantel ..... 190/118
3,010,552 11/1961 Davidson ..... 190/117
3,391,765 7/1968 Baker ..... 190/117
4,157,763 6/1979 Betlejewski et al. ..... 250/94 R

FOREIGN PATENT DOCUMENTS 1455618 10/1966 France ..... 190/117
344530 3/1960 Switzerland ..... 190/118
207930 12/1923 United Kingdom ..... 190/117

*Primary Examiner*—Gary E. Elkins

[57] ABSTRACT

This invention is the structure of handles, for attache cases or related products, that can also be used to lock the cases. It uses a pair of tension handles that has insertion poles on opposite ends to fit into the slots on the joints of case shells, and buckles on the other opposite ends to fasten with mortises on the joints of case shells by the use of the handles' tension, thus closing the case tightly and easily for light and safe lifting and carrying.

1 Claim, 4 Drawing Sheets

STRUCTURE OF A HANDLE WITH FASTENING FUNCTION

BACKGROUND OF THE INVENTION

Open-and-close cases, such as tool boxes of technicians, attache cases of salesmen, travel cases, hand-carry typewritters and lap-top computers, are familiar tools of carrying things. Such cases seem to be most economical and convenient means of carrying or transporting articles. As such cases must not be opened easily due to accidental collision, they use different fastening methods and structures designed according to specific purposes. For example, cases used to carry non-confidential matters are only equipped with simple fastening device, but cases used to carry confidential or valuable matters must be reinforced with numeric lock or other locking devices to enhance their security.

However, the locking device, regardless of its type, is separated from handles of cases, for instance, the area under the handles or on both sides of the handles. As handles are vital parts of such cases, why don't we make use of handles to perform the fastening function of cases used to carry non-confidential matters, or cases that require only a simple locking device that will not be opened easily by accidental collision? Therefore, the purpose of this invention is to provide a structure of handles, for the above-mentioned cases, that can be used to fasten cases tightly, easily and rigidly.

SUMMARY OF THE INVENTION

The special feature of this invention is the structure of handles, for the above-mentioned cases, that can also be used to fasten the cases. It is made up of a pair of handles that has insertion poles on opposite ends to fit into the slots on the joints of case shells, and buckles on the other opposite ends to fasten the cases with mortises on the joints of case shells by the use of the handles' tension, thus closing the cases easily and tightly for safe lifting or carrying.

BRIEF DESCRIPTION OF THE DRAWINGS

The structure of this invention seems to be simple, but it is the first of its kind today. The following drawings are attached to present this invention clearly for a better understanding of the investigation committee on the principle of its structure and operation.

Nomenclature:

| | | | |
|---|---|---|---|
| (1,2) | Handles | (3,4) | Case Shells |
| (11,21) | Buckles | (11',21') | Buckle Rims |
| (12,22) | Insertion Poles | (31,41) | Slots |
| (32,42') | Mortises | (42,32') | Mortises |

DETAILED DESCRIPTION OF THE PREFERRED EMBODIMENT

Figure 1:
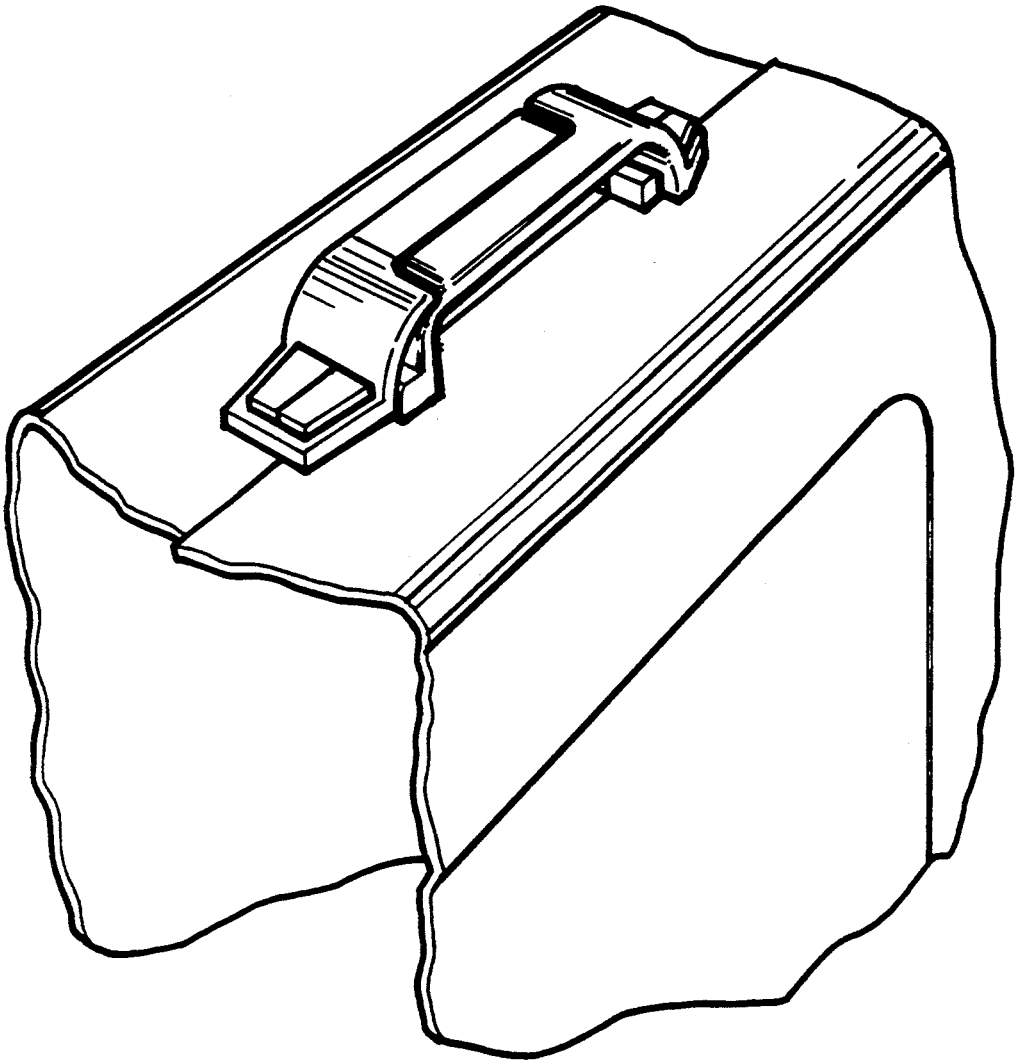
FIG. 1 is a 3-dimensional drawing for an example of this invention.
Figure 2:
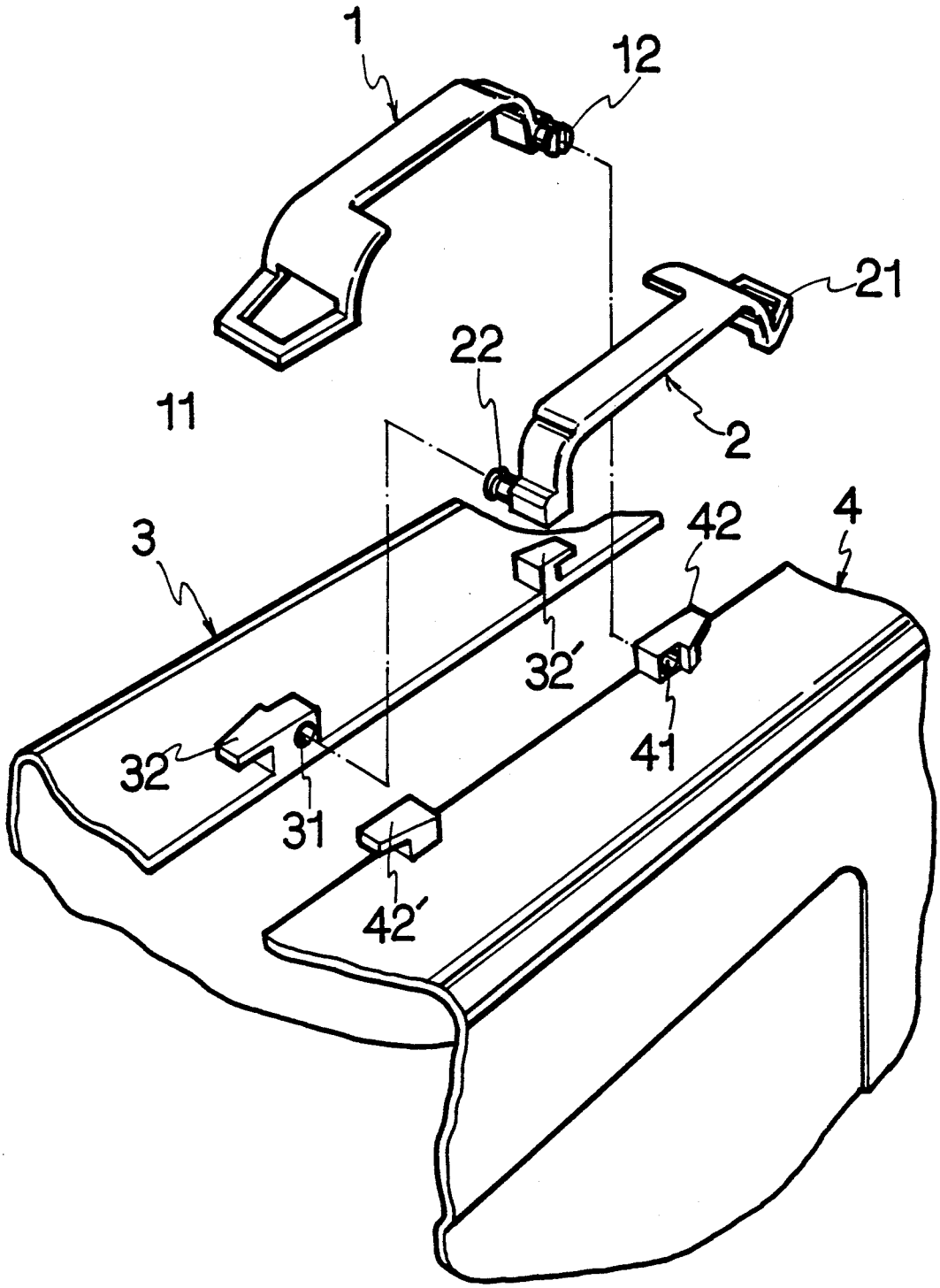
FIG. 2 is an analytic drawing for an example of this invention.

FIG. 1 is a 3-dimensional drawing for an example of this invention. It consists mainly of a pair of tension handles (1,2) that can be used on a case to be opened and closed. As shown by FIG. 2, the pair of handles (1,2) has insertion poles (12,22) on one end to fit into and rotate around two slots (31,41) on two joints of two case shells (3,4), and two buckles (11,21) on the other end to match with mortises (23,42',42 and 32') on the joints of case shells to lock the case.

Figure 3:
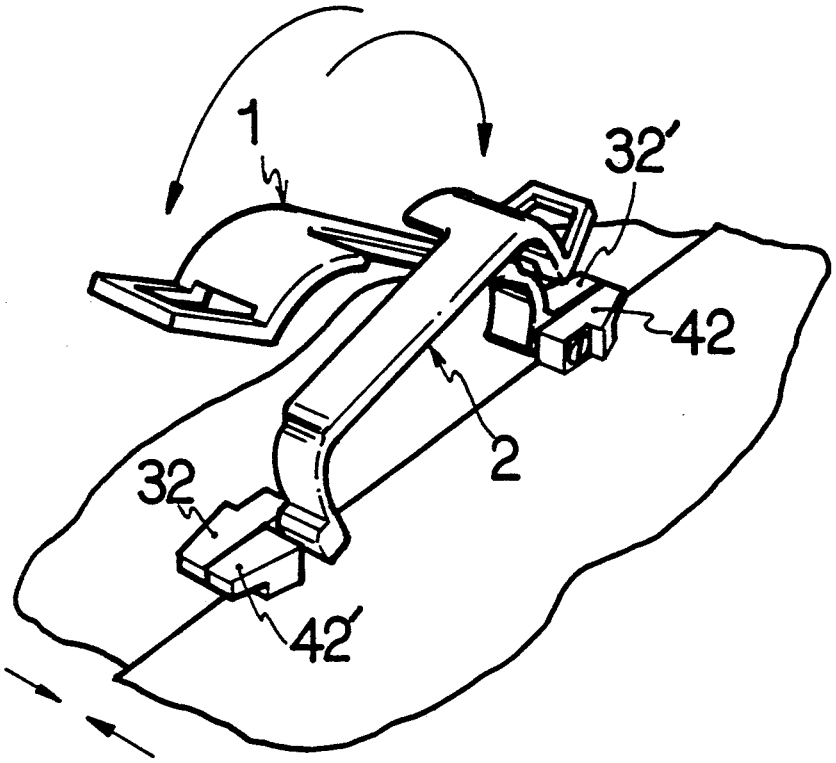
FIG. 3 illustrates the operation of this invention's example.
Figure 4:
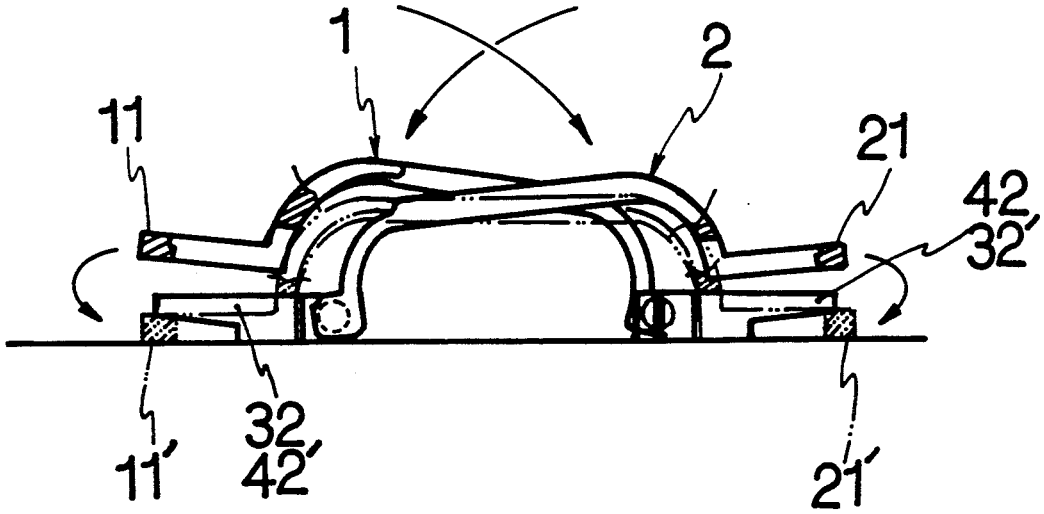
FIG. 4 shows the fastening operation for an example of this invention.
Figure 5:
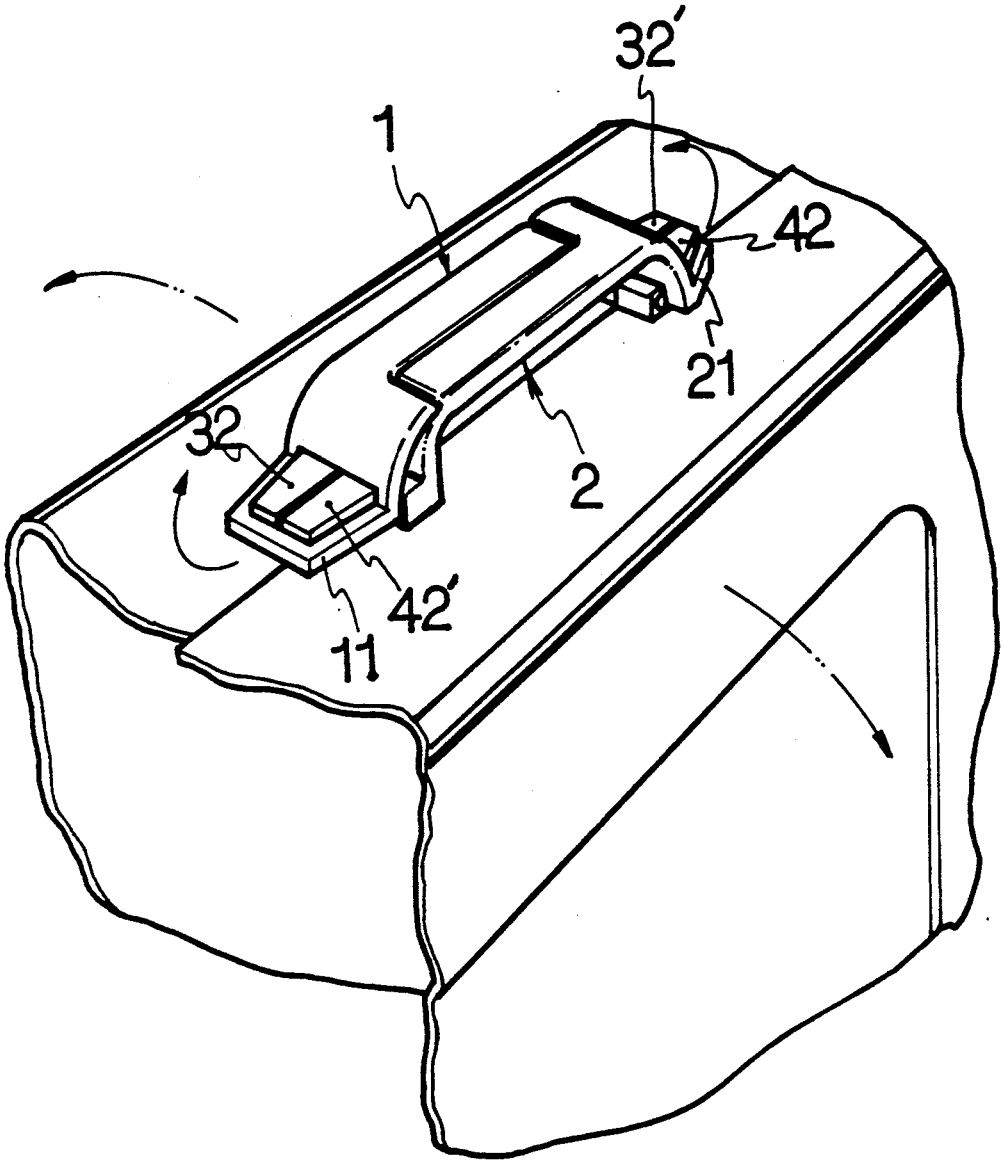
FIG. 5 shows the opening operation for an example of this invention.

To close the case, fit the insertion poles (12,22) of the pair of handles (1,2) into the slots (31,41) first, turn the pair of handles (1,2) around the slots (31,41) until the other ends (the ends with buckles (11,21)) lie on the mortises (32,42', 42 and 32'), as shown by FIG. 3 and FIG. 4, and make use of the handles' tension to fasten buckle rims (11',21') on the corresponding mortises (with 11' of 1 on 32,42', and 12' of 2 on 42,32'). With this invention, the case shells can be closed tightly, easily and quickly, and the case can be lifted or carried safely. To open the case, press the pair of handles (1,2) to stretch them and let the buckles (11,21) leave the mortises (32,42',42, and 32'), as shown by FIG. 5.

With this explanation, the investigation committee should have an adequate understanding on the structure and operation of this invention. This invention has, obviously, a structure that has not been used on cases on markets now, and its operation is very simple and practical. Besides, the production cost of this invention is lower. Therefore, we are applying to your esteemed bureau, according to article 95 of patent regulations, for patent right of new pattern. Your investigation and approval for this patent will be greatly appreciated.

What is claimed now is as following:

1. A structure of a handle arrangement for a case comprising:

a first handle having a first insertion pole at one end and a first buckle at another end;

a second handle having a second insertion pole at an end opposite said first insertion pole of said first handle, said second handle having a second buckle at another end;

a first case shell having a first slot for receiving said second insertion pole of said second handle, said first case shell having a first mortise for receiving said second buckle of said second handle; and a second case shell connected to said first case shell said second case shell having a second slot formed thereon for receiving said first insertion pole of said first handle, said second case shell having a second mortise for receiving said first buckle of said first handle.

* * * * *